United States Patent [19]

Streit

[11] 4,338,866

[45] Jul. 13, 1982

[54] KNOCK-DOWN DISPLAY STAND

[75] Inventor: Kenneth F. Streit, Mt. Prospect, Ill.

[73] Assignee: Techplastics, Inc., Ill.

[21] Appl. No.: 101,888

[22] Filed: Dec. 10, 1979

[51] Int. Cl.[3] ..... A47B 3/06

[52] U.S. Cl. ..... 108/111; 108/101; 108/153; 211/196; 248/165

[58] Field of Search ..... 248/159, 165; 206/821; 211/196, 194, 205, 49 R; 16/135, 138, 171, 167; 403/167, 173, 178; 108/101, 159, 153, 111

[56] References Cited

U.S. PATENT DOCUMENTS

| | | | |
|---|---|---|---|
| 197,147 | 11/1877 | Kramer | 108/153 |
| 392,871 | 11/1888 | Langenback | 108/153 |
| 397,225 | 2/1889 | Clow | 108/153 X |
| 432,425 | 7/1890 | Moan | 108/159 |
| 1,288,634 | 12/1918 | MacOrquodale | 108/101 |
| 1,934,846 | 11/1933 | Ebert | 108/101 |
| 2,526,246 | 10/1950 | Leeper | 108/101 |
| 3,126,844 | 3/1964 | Burne et al. | 108/111 |
| 3,263,355 | 8/1966 | March | 108/101 X |
| 3,338,189 | 8/1967 | Xavier | 108/111 |
| 3,806,124 | 4/1974 | Ippen et al. | 108/111 |
| 4,026,220 | 5/1977 | Schuring, Jr. | 108/111 X |

FOREIGN PATENT DOCUMENTS

| | | | |
|---|---|---|---|
| 21276 | 7/1929 | Australia | 108/101 |

*Primary Examiner*—James T. McCall

*Attorney, Agent, or Firm*—Dressler, Goldsmith, Shore, Sutker & Milnamow, Ltd.

[57] ABSTRACT

An injection molded, foam plastic, knock-down display stand. The display stand is formed from two major components. A V-shaped longitudinal member supports the shelves. The shelf supports have a number of open ended parallel slots. Joining two shelf supports together forms an X-shaped, free-standing shelf support column. Each shelf has an X-shaped opening to receive the shelf support column. Rotating the shelf through the slots joins the shelf to the shelf support column. Integral camming surfaces on the shelves lock the shelves and the shelf supports together to form a substantially erect display stand.

21 Claims, 7 Drawing Figures

FIG. 5
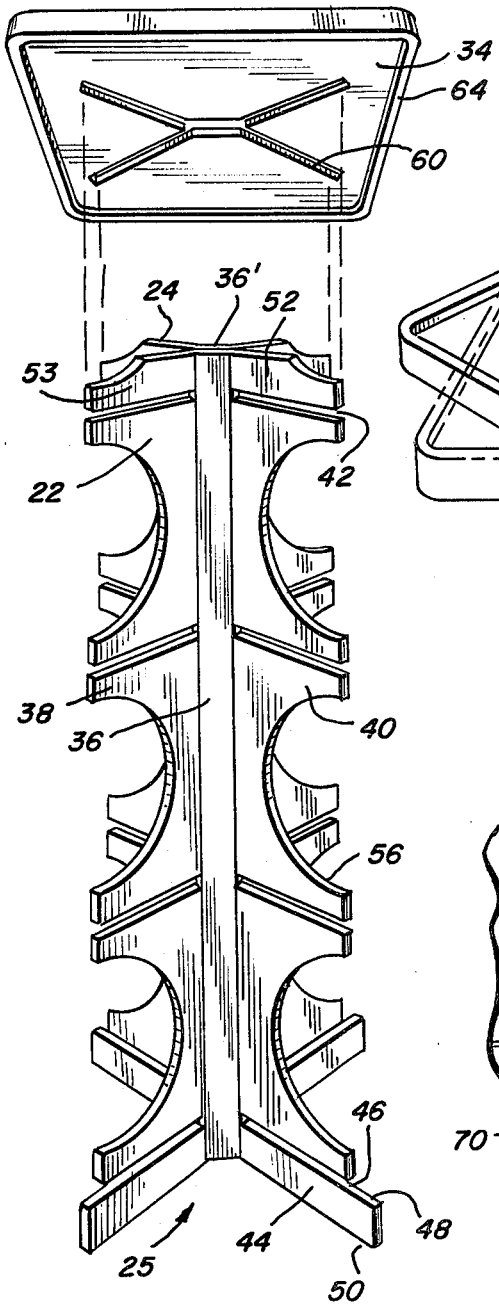
FIG. 6
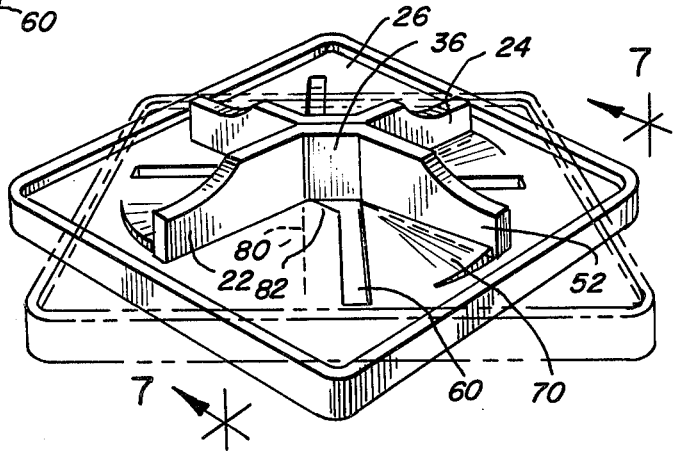
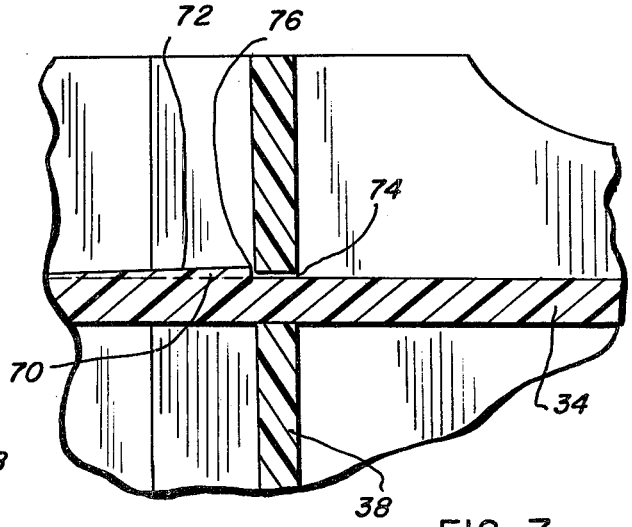
FIG. 7

KNOCK-DOWN DISPLAY STAND

TECHNICAL FIELD

Apparatus for storing and displaying goods. An injection molded, knock-down display stand featuring interlocking, one piece, self-supporting shelves and shelf supports.

BACKGROUND OF THE INVENTION

It is an axiom of marketing that: "if goods are to be sold, those goods must be brought to the public's attention." Advertising has been the traditional approach. Recently, behavioral studies have shown that a large number of purchases are motivated by what has been termed "impulse buying". While this term has some rather negative connotations, it adequately describes one method of marketing goods. In particular, it has been found that an essential requirement for selling goods by impulse buying is an attractive display of the product offered for sale.

Apart from the concept of impulse buying, it is universely agreed that packaging and the manner in which goods are displayed often spells the success or failure of a product. In other words, the buying public is significantly influenced by the manner in which goods are offered for sale.

Finally, it has been found that the buying public is forever attracted by novelty and newness. It is common experience to witness many products being sold under the labels "new", "improved" or "new and improved", etc.

In each of these cases, providing an attractive display for a product improves sales and the acceptance of new products. Balanced against the desirability of providing an attractive display is the fundamental objective of keeping marketing costs as low as possible. Heretofore, cardboard or corrugated cardboard displays have frequently been used to draw the attention of the public to a new product or a special offer or sale. While these displays have met with some success, they universally are of such design and construction that they cannot withstand the rigors of long term service. In addition, they are not often designed for being taken apart and put away in storage for use at a later date. Consequently, over the long term, these display stands, while inexpensive from a first cost point of view, are uneconomical if repeated use is to be made of them. An attractive, economical, knock-down display stand would be a significant addition to the field of package and display engineering.

One important advantage of injection molded plastics is that production rates are high and unit costs are low. In addition, quite intricate parts can be produced since dimensional accuracy is high. Foam plastics are noted for their strength and light weight. Since dimensional accuracy is high, interlocking of thin walled components becomes especially feasible. These three features (low cost, dimensional accuracy and high strength per unit weight) could work hand in hand to solve the problem of producing a low cost, knock-down, attractive display stand.

SUMMARY OF THE INVENTION

The present invention provides a unique design for a low cost, injection molded, foam plastic, knock-down display stand. This stand is suited for displaying packaged goods and other modular products. The invention consists of two primary components.

The first component is a longitudinal V-shaped member having a series of open ended, parallel slots. The V-shaped member includes a transverse edge such that the member is self-standing. At the opposite end of the V-shaped member is a top piece facilitating the insertion of shelves. The V-shaped member serves as a shelving support means. Two such members, when placed back to back, form a generally cruciform shaped columnar structure. Shelves are added to this column.

The second principal component is a shelf member. The shelf member features a central opening having the dimensions and shape of the cross section of the cruciform support column. The thickness of the shelf is equal to the dimension of the open-ended slots on the shelving support means. In addition, the surface of the shelf includes a ramp-like camming surface acting both as a stop and a lock when the shelves are joined to the support means. The shelf includes an upper lip on one side to prevent goods from slipping off the shelf and a lower lip to strengthen the shelf and resist buckling. Both lips are integrally formed with the shelf.

The display stand is constructed by inserting the shelves over two V-shaped shelf support members that have been placed back to back so as to form a cruciform shelf support column. Each shelf is lowered to the vicinity of a set of open-ended slots. Each shelf is then rotated through an angle to engage the camming surface. The cam then locks the shelf support member in a position away from the opening. Depending on the height and spacing of the display, any number of shelves may be added in this manner. Once the last shelf has been added, a display stand is formed.

Should it become necessary to take down the display stand for storage or use at a later date, all that is necessary is to unlock the shelving supports from the camming surface on the shelf, twist the shelf to line up the opening with the cruciform support column, and lift the shelf free from the support column. The shelves can conveniently be stacked and the support column separated into interleafing V-shaped members. Each of these two principal components can be easily stored out of the way for subsequent use.

BRIEF DESCRIPTION OF THE DRAWINGS

FIG. 5 is a perspective view illustrating the assembly of the shelves on the shelving supports.

FIG. 6 illustrates the method used to insert and lock a shelf on the shelf support column.

FIG. 7 is a partial, cross-sectional, elevational view of the shelf shown in FIG. 6 as viewed along line 7—7 of FIG. 6.

DESCRIPTION OF THE PREFERRED EMBODIMENTS

Figure 1:
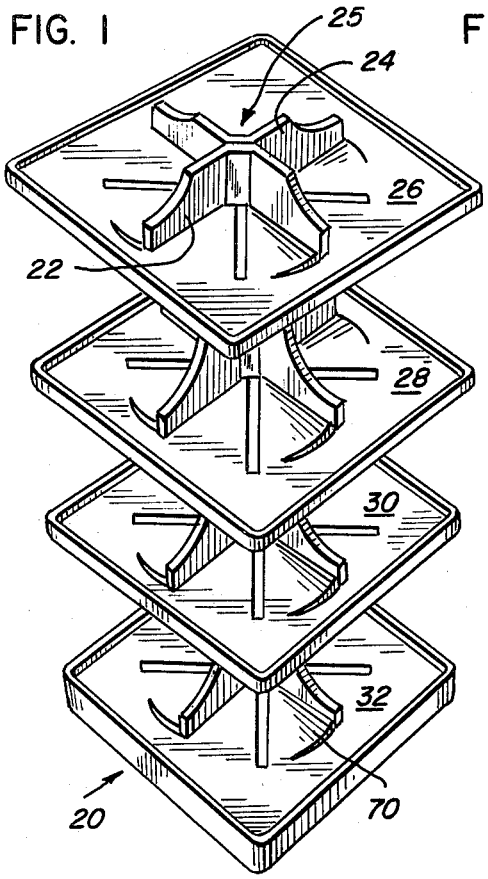
FIG. 1 is a perspective view of the completed display stand as viewed from point above the display stand.

While this invention is susceptible of embodiment in many different forms, there is shown in the drawing and will herein be described in detail specific embodiments with the understanding that the present disclosure is to be considered as an exemplification of the principles of the invention and is not intended to limit the invention to the specific embodiment illustrated.

While this invention may be made of many different materials, suitable materials include polyethylene and polypropylene. The preferred material is injection molded structural foam made of polyolefin plastic for both of the shelves and shelf support means. Full density linear polyethylene is transformed by a foaming agent into a so-called structural plastic. This plastic is lighter and less dense than so-called full density polyethylene. Structural foam offers several advantages over full density injection molded plastic. Specifically, flexural rigidity can be increased as much as four times over that of a solid part of equal weight. For polyethylene, it is well-known that as the density increases, so does its tensile strength, hardness, rigidity, and heat resistance. For this reason, structural foam injection molded components are preferred.

FIG. 1 provides an illustration of a display stand of the present invention when fully assembled and ready for use. Specifically, the display stand 20 includes two V-shaped shelf support members 22 and 24 and three identical shelves 26, 28 and 30 and a base shelf 32. The two V-shaped support members 22 and 24, when placed back to back, form a cruciform shaped shelf support column 25.

Figure 3:
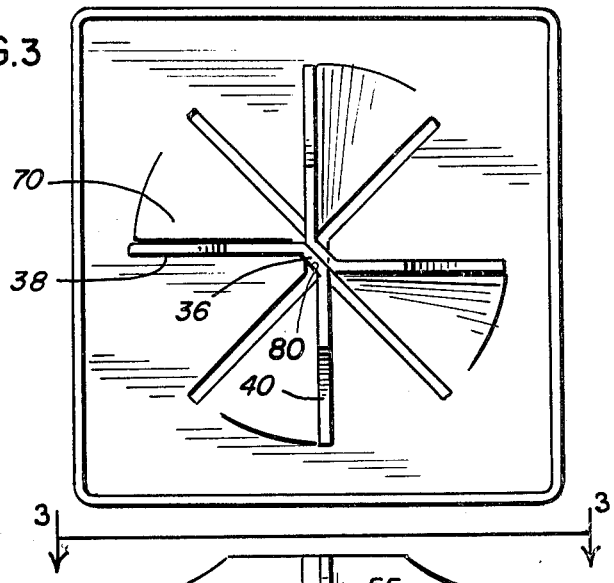
FIG. 3 is a plan view of display stand shown in FIG. 2 as viewed along line 3—3 of FIG. 2.

FIG. 3 is a cross-sectional elevational view of the display stand shown in FIG. 1 illustrating the relationship of the shelves and the shelf support column 25.

FIG. 5 illustrates the major components of the invention, namely a shelf 34 and two shelf supports 22 and 24. Each of the shelf supports is identical to the other. Each shelf support includes a longitudinal central spine 36 and integrally formed transverse wing members 38 and 40. Each wing member is identical to the other and is joined to the spine 36 at an angle so as to define a generally symmetrical shelving support means having a generally V-shaped cross-section.

Figure 2:
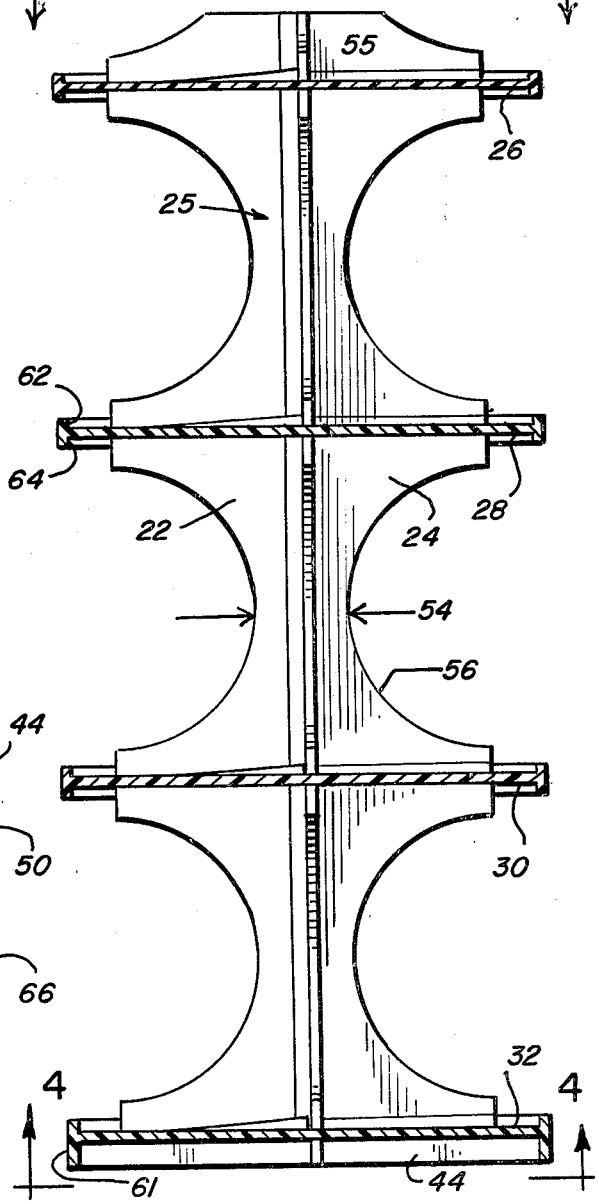
FIG. 2 is a cross-sectional, elevational view of the display stand shown in FIG. 1 illustrating the shelving support means locked together with the shelves.

FIG. 2 is a top view of a shelf and shelf support member when in the assembled position. It illustrates in particular the relationship between the two wings 38 and 40 and the central spine 36 and the V-shape. Returning to FIG. 5, each wing has a plurality of open ended parallel slots 42. The thickness of each slot is generally equal to the thickness of the shelf to be supported. The vertical distance between each pair of slots determines the space between each tier of shelves. While the specific embodiment illustrated has shelf slots uniformly spaced, the shelf slots may be of any convenient spacing. For example, progressively shorter slots may be employed from the bottom to the top of the shelf support so as to form a "wedding cake" pattern. Each shelf slot 42 has the closed end at the intersection of the wing and spine 36. Other variations are possible. The longer the slot, the greater the proportion of shelf supported.

The slots 46 at the lower end of the shelf supports are of a slightly different design. Specifically, the wing portion 44 adjacent the lowest slot 46 is extended outwardly in the transverse direction to define a shelf stop 48 and a base edge 50. Specifically, by extending this portion 44 of the wing 40, the shelf inserted at the lowest slot on the shelf support is prevented from slipping past the opening of the lowest slot. This is important because (as will be discussed in detail at a later point) the lowest shelf is the first shelf anchoring the two support members 22 and 24 together. Until this shelf is added, there is nothing to hold the two shelf supports together. In addition, by extending the wing 44, the base edge 50 of the shelf support member is also extended thereby improving the stability of the overall structure.

Figure 4:
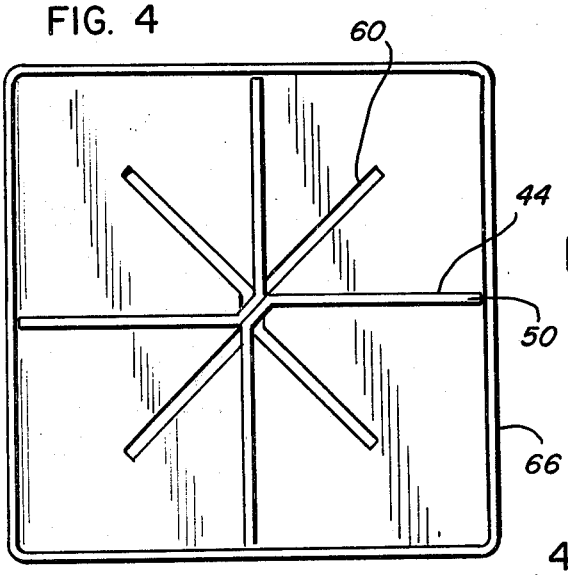
FIG. 4 is a bottom view of the display stand shown in FIG. 2 as viewed along line 4—4 of FIG. 2.

While this extension 44 may be of any dimension, the aesthetic appearance of the stand is improved by lengthening this portion of the wing a distance approximately equal to the width of a base shelf. Specifically, as illustrated in FIG. 4, each wing extension 44 then acts as a rib reinforcing the shelf along the entire breadth and width of the shelf.

At the opposite end of the shelf support structure, the wings 52 and 53 are foreshortened to facilitate the insertion of shelves. Structurally, it is only necessary that there be a sufficient length at the top end 52 to hold the top shelf in place. This distance 55 (see FIG. 2) is ordinarily of sufficient dimension to add rigidity to the top shelf 26 and to resist spreading apart of the top shelf slots 42 when the top shelf 26 is inserted.

The portion of each wing 54 between two sets of parallel slots (see FIG. 2) needs only to be of the dimension needed to support and transmit the loads between successive tiers of shelves. This distance is ordinarily sufficient to provide the thickness of material and to resist separation of the slots when the shelves are inserted. A suitable ornamental design such as circular cutouts 56 not only improves the overall aesthetic appearance, but eliminates unnecessary plastic material. Removal of this material from the stand not only reduces its overall weight, but also reduces the cost of manufacture.

Each shelf support member is shown in the figures paired with an identical shelf support member to form a columnar structure 25 having a cruciform cross-section (see FIG. 1). It is also possible to initially fabricate the shelf support column 25 as one X-shaped piece. One advantage to this approach is that the shelving support column 25 then forms free standing rigid structure without the shelves being attached.

The second principal component is the shelf. The shelves are of identical shape and design. Each shelf includes a central cruciform shaped opening 60 (see FIG. 5). The shape and dimension of this opening matches the lateral cross-section of the two shelf support elements used to support the shelves. The thickness of the shelf is substantially equal to the width of each slot. While the shelves may be of any convenient shape, square shelves with rounded corners are illustrated for the purpose of discussion. Similarly, while one opening is shown, each shelf may have multiple openings for use with two or more shelf support columns. In any case, the shelves include an upper peripheral lip 62 (see FIG. 2) and a lower lip or rib 64. The upper lip prevents goods and other items seated on the shelf from slipping off. The lower lip 64 acts like a rib resisting the tendency of the shelf to buckle and improving the strength of the shelf at the edges in view of the opening 60.

While the display stand will function if each shelf is identical, the overall appearance and function of the stand may be improved by using a specially formed base shelf 32. The base shelf (See FIG. 2) is otherwise identical to each of the other shelves with the exception that the lower lip 66 is of greater length. In general, the length of the lower lip is equal to the thickness of the wing extension 44. In this configuration, the lower shelf is supported by both the wing extensions 44 and the lower lip 66. Added strength at the lower shelf is important in that is insures a fundamentally rigid structure and provides a means to resist the tendency of the display stand to tip over when heavily loaded at the upper end in comparison to the lower end (i.e., a top heavy condition).

An intergrally formed ramp or camming surface 70 (See FIG. 1) may be added to each shelf. This ramp 70 facilitates joining the shelf support column 25 to the shelf by locking the two together. This ramp or camming member 70 extends from the surface of the shelf to a distance generally about one half the angular separation of each wing relative to the base. Thus, in the case of wings formed at right angles to each other, the ramp will extend through an angle of about 45 degrees. Other angular separations are possible, but the preferred spacing places the wings equidistant from the legs of the opening and in a generally closed area. Each ramp extends upwardly from a surface of the shelf from a point beginning along one of the edges of the opening 60.

FIGS. 1 and 6 show a perspective view of the ramp and the manner in which the surface rises from the edge of the shelf opening 60. FIG. 7 is an enlarged, partial, cross-sectional, elevational view illustrating the position of a ramp 70, a shelf 34 and a shelf support wing 38. It also shows how the top surface of the ramp 72 is intergrally formed relative to the width of the shelf 34 such that the overall thickness is greater than the width of the slot. Therefore, when the shelf 34 is forced through the slot by the wedging effect of the ramp, the slot is separated and drawn apart until the wing passes beyond the edge 76 of the ramp 70. At this point the slot is free to return to its original shape and the support member is held in place relative to the shelf. Dimensional accuracy provided with injection molding insures that adequate clearances will be maintained so as to form a substantially rigid structure. Structural foam plastic possesses sufficient flexibility to use this wedging effect to maximum advantage.

The assembly of the display stand will now be described in detail with attention being given to specific features of the invention. FIG. 5 shows how the two shelf support members 22 and 24 have been placed, spine 36 to spine 36' so as to form a structure having a generally cruciform cross-section.

The particular nature of the cross-section and the relationship between the two shelf support members 22 and 24 is best illustrated in FIG. 3. There, it is shown that while each of the wings 38 and 40 are at 90 degrees relative to each other, no one wing falls in the same transverse plane. This is especially significant. If simple V-shaped structure were formed not having the spine such that each of the wings would meet at a 90 degree or other angle, then the opening in the shelf needed for passing through the shelf supports would have two legs of the shelf openings in the same line. This would severely affect the overall strength of the shelf in that the only support between the opposite halves would be the remaining material around the perimeter of the shelf. By joining two wings 38 and 40 at a central spine 36, each of the four wings then requires a shelf having an opening with legs that are offset from one another. The overall strength of a shelf having such an offset opening is much stronger than a shelf with a simple series of leg openings in the same line with each other.

The lowest shelf, or base shelf 32 is the first shelf joined to the two shelf supports 22 and 24. It should be recalled that one embodiment of the invention envisages a one-piece shelf support column. The base shelf 32 is prevented from passing completely through the support member by the stop 48 provided at the wing extension 44. Again, as was previously mentioned, it is important in the overall assembly of a display stand using a two-piece shelf support column that the first shelf or base shelf be inserted as easily as is possible in that the two shelf supports 22 and 24 are only held together by the shelves. In other words, until the base shelf is installed, the two shelf supports are not joined. Once the base shelf 32 is in place, the remaining shelves can be easily installed.

FIG. 6 illustrates the manner in which the shelves may be locked to the shelf supports. The specific shelf 26 illustrated there is the top shelf 26. The principle is still the same. Shown in phantom is the position of the top shelf 26 immediately after insertion over the two shelf supports 22 and 24 and prior to rotation of the shelf 26 to its final position. Each shelf is first aligned with the slots at the elevation it is to be installed. Once the opening 60 has been aligned with a set of slots, the shelf is rotated in such a direction so as to force engagement of the slot with the ramp 70. This forces the shelf support wings into engagement with the shelf. After passing beyond the dropoff point 76 (See FIG. 7) of the ramp 70, the shelf 34 and wings 38 are locked together.

Because of the particular shape of the opening 60 and the slots, further rotation of the shelf beyond the dropoff point 76 of the ramp 70 would not result in realignment of an opening with a support element (See FIG. 3). In fact, the particular and unique design of the shelf openings and shelf supports is such that further rotation beyond the dropoff point 76 of the ramp 70 is prevented. This is because the trailing slot edge 80 (See FIG. 6) comes into engagement with the complementary surface 82 of the spine side of the opening 60. Thus, the shelf support is locked in position against both clockwise and counterclockwise rotation. In this regard, with reference to FIG. 3, ramp 70 prevents the shelves from rotating clockwise with respect to the spine, whereas the engagement between edge 82 and surface 80 prevents the shelves from rotating counterclockwise relative to the spine.

In one variation of design, the base shelf 32 as especially constructed and configured (See FIG. 2). It is otherwise identical to each of the other shelves with the exception that the lower lip or rib 66 is of the same dimension as the wing extension 44 of the shelf supports. Once the base shelves of this design is rotated in position, each vertical end of the wing extension 44 comes into engagement with the lower lip 66 so as the form the structure illustrated in FIG. 4. The lip 66 of the shelf adds a wide base to the display stand.

Finally, should it become necessary to take apart the display stand for storage, it is only necessary to reverse the steps previously described. Ordinary manual force applied with the hands to each side of the wing on each side of the slot 42 is all that is necessary to spread the slot 42 sufficiently to clear the ramp 70 and thereby overcome the force holding the shelf in place. Once the wing has been placed in engagement with the ramp simple rotation will result in the removal of the shelves from the shelf supports.

From the foregoing, it will be observed that numerous variations and modifications may be affected without departing from the true spirit and scope of the novel concept of the invention. It will be understood that no limitation with respect to the specific apparatus illustrated herein is intended or should be inferred. It is, of course, intended to cover by the appended claims all such modifications as fall within the scope of the claims.

What is claimed is as follows:

1. A display stand comprising:

(a) means for supporting shelves, said supporting means defining a longitudinal V-shaped, symmetrical structure having two intergrally formed, generally flat, transversely extending wings, each wing being identical to the other, each wing having a plurality of parallel slots having one open end, each slot being substantially perpendicular to the longitudinal axes of said wings, said slots defining the thickness of the shelf to be supported, the longitudinal distance between said slots defining the space between successive tiers of said shelves, each wing having an edge substantially perpendicular to the longitudinal axis of said wing, said structure freely standing erect when resting on said edge; and (b) a plurality of generally flat planar shelves, each shelf having at least one X-shaped opening in the plane of said shelf, said openings being substantially the same shape as the cross section of the structure formed by mating together a pair of supporting means apex to apex, said display stand being formed by joining said pair of supporting means so as to define a generally cruciform shaped column, said pair of supporting means being held together by adding shelves to said pair of supporting means, shelves being added by inserting each of said shelves over the top side of said pair of supporting means, each shelf being aligned to a set of paired slots in said pair of supporting means and rotated in the direction away from said shelf opening, positioning said wings over a closed surface of said shelf having the effect of interlocking said shelves and said pair of supporting means to form a self-supporting vertical array of parallel shelves.

2. The display stand defined in claim 1, further including a base shelf, said base shelf having at least one X-shaped opening in the plane of said shelf, said opening being substantially the same shape as the cross section of said pair of support means, said base shelf having an integrally formed peripheral lip, said lip having a height substantially equal to the dimension between said wing edge and the closest adjacent slot, said lip holding said array of parallel shelves erect and stabilizing said array of shelves against tipping.

3. The display stand defined in claim 1, wherein each of said shelves have one of said openings in the center of said shelf.

4. The display stand defined in claim 1, wherein said wings are perpendicular to each other.

5. The display stand defined in claim 1 wherein said shelves include an integrally formed camming surface extending from the plane of the shelf and terminating at an angular position from said opening approximately one half of the angular separation of said wings.

6. The display stand defined in claim 1, wherein said cruciform shaped column is defined by two integrally connected supporting means.

7. A display stand of shelves, comprising:

(a) means for supporting shelves, said support means defining two integrally formed longitudinal flat wings and a spine, said wings spreading away from said spine, to define a generally V-shaped symmetrical structure, the longitudinal axis of said support means being defined by the line formed in the plane of the spine by the intersection of two planes each parallel to the plane of one of said wings, each wing defining a plurality of slots, each slot having one open end, said slots defining the general thickness of the shelves to be supported, the space between said slots defining the space between respective tiers of said shelfs, the closed end of said slots being adjacent said spine, the slots at one end of said support means defining the position of the base shelf, the slots at the opposite end of said support means defining the position of the top shelf, each of said slots being substantially perpendicular to the longitudinal axis of said support means, each wing having an edge substantially perpendicular to said longitudinal axis, said support means being free standing when resting against said wing edges, the cruciform structure formed by positioning together two support means spine-to-spine and defining a shelving support column; and (b) a plurality of shelves, each shelf having an opening at its center substantially conforming to the lateral cross-section of said shelving support column, each shelf receiving said shelving support column through said opening, one side of each shelf having at least one integrally formed raised camming surface extending from the surface of said shelf to a point approximately one-half the angular separation of said wings, the end of said camming surface defining a stop, said display stand being formed by joining said pair of shelving support means spine-side to spine-side to form said shelving support column, said shelving support column being anchored and held together by said base shelf, each shelf being added by: (1) inserting each of said shelves over the top of said shelving support column; (2) aligning said shelf opening with a set of four slots on said shelving support column; and (3) rotating said shelf so as to engage said camming surface, rotating said shelf past said camming surface locking said shelf support means onto a closed surface of said shelf, successive shelves interlocked to said pair of shelf support means forming a self-supporting vertical array of shelves.

8. The display stand defined in claim 7, further including a base for anchoring and holding together said shelving support column, said base fitting within the slots defining the position of said base shelf.

9. The display stand defined in claim 8, wherein said base includes a shelf portion, said shelf portion having generally the same planar cross section as the other shelves on said display stand.

10. The display stand defined in claim 7, wherein that portion of each wing between the slot for said base shelf and said substantially perpendicular edge is extended in the transverse direction by a dimension generally greater than the transverse dimension of the other side of said slot, said wing extension defining a stop for said base shelf, the distance between said edge and said base shelf slot defining the height of said base shelf.

11. The display stand defined in claim 10, wherein a base is defined by the wing extensions of two shelf support means held together by a shelf inserted in said base shelf slots and locked in position by said camming surface.

12. The display stand defined in claim 7, wherein that portion of said wing between the slot defining said top shelf and the nearest edge of said wing defines a top piece, said top piece having a smooth edge to facilitate the insertion of shelves on said shelving support column.

13. The display stand defined in claim 7, wherein said wings are generally perpendicular to each other.

14. The display stand defined in claim 7, wherein each of said shelves includes at least four integrally formed camming surfaces rising from the surface of said shelf, one camming surface being for each of said four wings defined by said shelving support column, each camming surface locking in place one of said four wings relative to the surface of said shelf.

15. The display stand defined in claim 7, wherein said camming surface begins at one side of each leg of said opening in said shelf.

16. The display stand defined in claim 15 wherein said camming surface extends generally along the entire transverse length of said one side of said opening.

17. The display stand defined in claim 10, wherein said base shelf includes a flange extending around the perimeter of said shelf, the length of said flange being equal to the elevation of the base shelf; said flange adding stability of said to display stand.

18. The display stand defined in claim 7, wherein said shelves are added to said shelving support column by alternately rotating each shelf clockwise and counterclockwise, said alternate insertion compensating for any twist imparted to said wings by being locked to said shelves thereby holding said display stand erect.

19. The display stand defined in claim 7, wherein said camming surface is on both sides of said shelf.

20. The display stand defined in claim 7, wherein a shelf rotation stop is defined by the closed end of said slot and the inside edge of the opening defined by said spine, said closed end of said slot engaging with said inside edge of said opening upon rotation of said shelf on said shelving support column, whereby rotation of said shelf beyond the end of said camming surface is limited by said shelf rotation stop.

21. The display stand defined in claim 7, wherein said pair of support means are integrally joined together to form said shelving support column.

* * * * *